US005704779A

United States Patent [19]

Enkegaard

[11] Patent Number: 5,704,779

[45] Date of Patent: Jan. 6, 1998

[54] METHOD AND COOLER FOR COOLING PARTICULATE MATERIAL

[75] Inventor: Torben Enkegaard, Copenhagen, Denmark

[73] Assignee: F. L. Smidth & Co. A./S, Denmark

[21] Appl. No.: 424,326

[22] PCT Filed: Dec. 7, 1993

[86] PCT No.: PCT/EP93/03444

§ 371 Date: Apr. 21, 1995

§ 102(e) Date: Apr. 21, 1995

[87] PCT Pub. No.: WO94/15161

PCT Pub. Date: Jul. 7, 1994

[30] Foreign Application Priority Data

Dec. 23, 1992 [DK] Denmark ..... 1546/92

[51] Int. Cl.[6] ..... F27D 15/02

[52] U.S. Cl. ..... 432/78; 432/77

[58] Field of Search ..... 432/71, 77, 78, 432/80, 103, 105, 108, 109, 117, 121, 136, 152

[56] References Cited

U.S. PATENT DOCUMENTS 2,587,379 2/1952 Petersen ..... 432/78

FOREIGN PATENT DOCUMENTS 2025588 1/1980 Germany .

*Primary Examiner*—William E. Tapolcai

*Assistant Examiner*—Gregory Wilson

*Attorney, Agent, or Firm*—Brumbaugh, Graves, Donohue & Raymond

[57] ABSTRACT

A cooler (1) for cooling particulate material from a kiln, wherein the material upon entry into the cooler (1) is distributed to a material bed on a stationary supporting surface (11) in the form of a tray, while cooling gas, such as atmospheric air, is blown up through the material bed from injectors in the tray in a uniform and evenly distributed manner. The material is conveyed forward across the supporting surface (1) and through the cooler (1) by means of a separate mechanical conveying device (17). It is thus possible to split the three functions of such a cooler, viz. to support the material, to distribute the cooling gas across the supporting surface and to convey the material forward across the supporting surface, into functions which are independent of one another, so that each function can be optimized.

4 Claims, 9 Drawing Sheets

METHOD AND COOLER FOR COOLING PARTICULATE MATERIAL

The present invention relates to a cooler for cooling particulate material which has been heat-treated in an industrial kiln, such as a rotary kiln for manufacturing cement clinker, wherein the material is continuously supplied to and through the inlet of a cooler, which further comprises an outlet, end walls, side walls, a bottom and a ceiling.

Coolers of the above-mentioned kind are known for example from the EP-A-167,658 and EP-A-337,383 and DE-A-3734043. A common characteristic of these coolers is that they have a cooler grate surface for receiving and cooling the material which has been heat-treated in the rotary kiln, the grate surface being constructed of overlapping, alternately stationary and movable rows of grate elements, thereby causing the material to move across the grate surface. Each grate element is provided with through-going cooling gas channels for injection of cooling gas into the material from an underlying chamber. In some cases, the grate elements are provided with cooling gas from separate chambers, whereas, in other cases, the grate elements are divided into groups which are supplied with cooling gas from a common chamber.

As will appear from the above, the grate surface in the known coolers serves three purposes, viz. to support the material, to distribute the cooling gas across the material bed and to convey the material through the cooler. The fact that the grate surface thus has three functions to perform makes it necessary to accept a compromise with regard to the efficiency of each function.

The known coolers also have the disadvantage that, in practice, it is difficult to achieve an even distribution of the cooling gas across the entire grate surface, and hence a good heat exchange between material and cooling gas, since the cooling gas will not only pass through the cooling gas channels provided for this purpose but also through the gaps inevitably present between the overlapping rows of stationary and movable grate elements. Also, the wear sustained on the grate elements due to the relative movement between the elements will be relatively large. A further disadvantage, relating to the fact that the cooling surface has movable grate elements which are supplied with cooling gas individually or in groups from an underlying chamber, is that the connecting ducts for cooling gas to these chambers are exposed to a relatively large mechanical wear, which may result in leaks, and hence a pressure loss.

It is the object of the present invention to provide a method and a cooler for cooling particulate material by which the aforementioned disadvantages are obviated.

GB-A-2025588 discloses a cooler for cooling particulate material which has been heat-treated in an industrial kiln, such as a rotary kiln for manufacturing cement clinker; the cooler comprising an inlet, an outlet, end walls, side walls, a bottom and a ceiling; at least one stationary supporting surface for receiving and supporting the material which is to be cooled; means for injecting cooling gas into the material at a plurality of positions along the supporting surface; and at least one separate mechanical conveying device for conveying the material along the supporting surface.

According to the present invention, such a cooler is characterized in that the or at least one of the stationary supporting surface(s) consists of a tray having the form of a rectangular box with bottom, side walls and end walls, the tray being arranged to contain, during operation, a quantity of the particulate material which is to be cooled; and in that the gas injection means, such as tubes with preferably downwardly facing holes, are fitted within the tray.

With this construction, it is possible to split the three previously mentioned functions of the cooler, viz. to support the material, to distribute the cooling gas across the material bed and to convey the material forward across the supporting surface, into functions which are independent of one another. Since the entire supporting surface for the material is stationary, undesirable passage of false air through this surface can be avoided. Also, the wear on the supporting surface will be limited to that induced by the movement of the material across the surface. The fact that the entire supporting surface is stationary further has the advantage that less stringent requirements apply with respect to the connecting ducts for cooling gas to the supporting surface. Since, according to the invention, the cooler is provided with a multitude of means for injecting the cooling gas, it is possible to control the air distribution across the supporting surface, and hence the cooling of the material bed, for optimum heat exchange between material and cooling gas.

In that, according to the invention, the cooler comprises a separate, mechanical conveying device, the movement of the material across the supporting surface can be controlled in a simple manner, and it is further possible through the location of the device to determine which part of the material bed is to be moved, which again makes it possible to reduce the wear on the supporting surface.

The cooler may be designed so that it comprises two trays, one of which is located under the other in such a way that the material which leaves the upper tray falls down on the underlying tray for further treatment thereon, and so that the material is conveyed forward across both trays by one and the same conveying device.

The conveying device may be a chain conveyor being directly supported on the supporting surface, a chain conveyor being supported on rails fitted at a distance above the supporting surface, a reciprocating scraping system comprising a number of scraping elements extending transversely to the direction of movement of the material and being moved to and fro in the direction of movement of the material, a number of screw conveyors extending in the direction of movement of the material, or similar devices.

In a special embodiment of the cooler according to the invention, the cooler is divided into a first and second parts by means of a damming wall which is suspended from the cooler ceiling and extends transversely to the direction of movement of the material, thereby ensuring that the material bed is thickest in the first part of the cooler as a means of increasing the counterflow-cooling effect in this part of the cooler.

The most effective heat exchange is achieved by a direct counter-current heat exchange between material and cooling gas and in order to ensure effective cooling of the material immediately upon its entry into the cooler, it is advantageous that the material upon its entry into the cooler and before being distributed on the first, stationary supporting surface, falls down on an inclined, stationary surface and forms a material column thereon, that cooling gas is blown up through the material column, and that the material closest to the inclined surface is conveyed towards its lower end partly by the action of gravity and partly by means of the conveying device which is installed at the subsequent supporting surface.

Thus as an additional feature, the cooler may comprise an additional, substantially inclined grate surface which is located immediately at the inlet of the cooler and without any appertaining conveying device, and constructed of a number of grate plates each of which is provided with openings, such as through-going slots or holes, for injection of cooling gas through the material from an underlying chamber in order to provide a certain pre-cooling of the material.

As yet another feature of the cooler according to the invention, the cooler may comprise at least two supporting surfaces in series, each being provided with means for injection of cooling gas and a conveying device.

To improve the cooling efficiency of the cooler, a crushing machine, such as a roller crusher may be installed between two of the supporting surfaces.

In order to protect the conveying device from hot clinker from the kiln, there may be provided means for transporting some of the cooled material back to the cooler inlet to protect the conveying device from hot clinker from the kiln.

Figure 8:
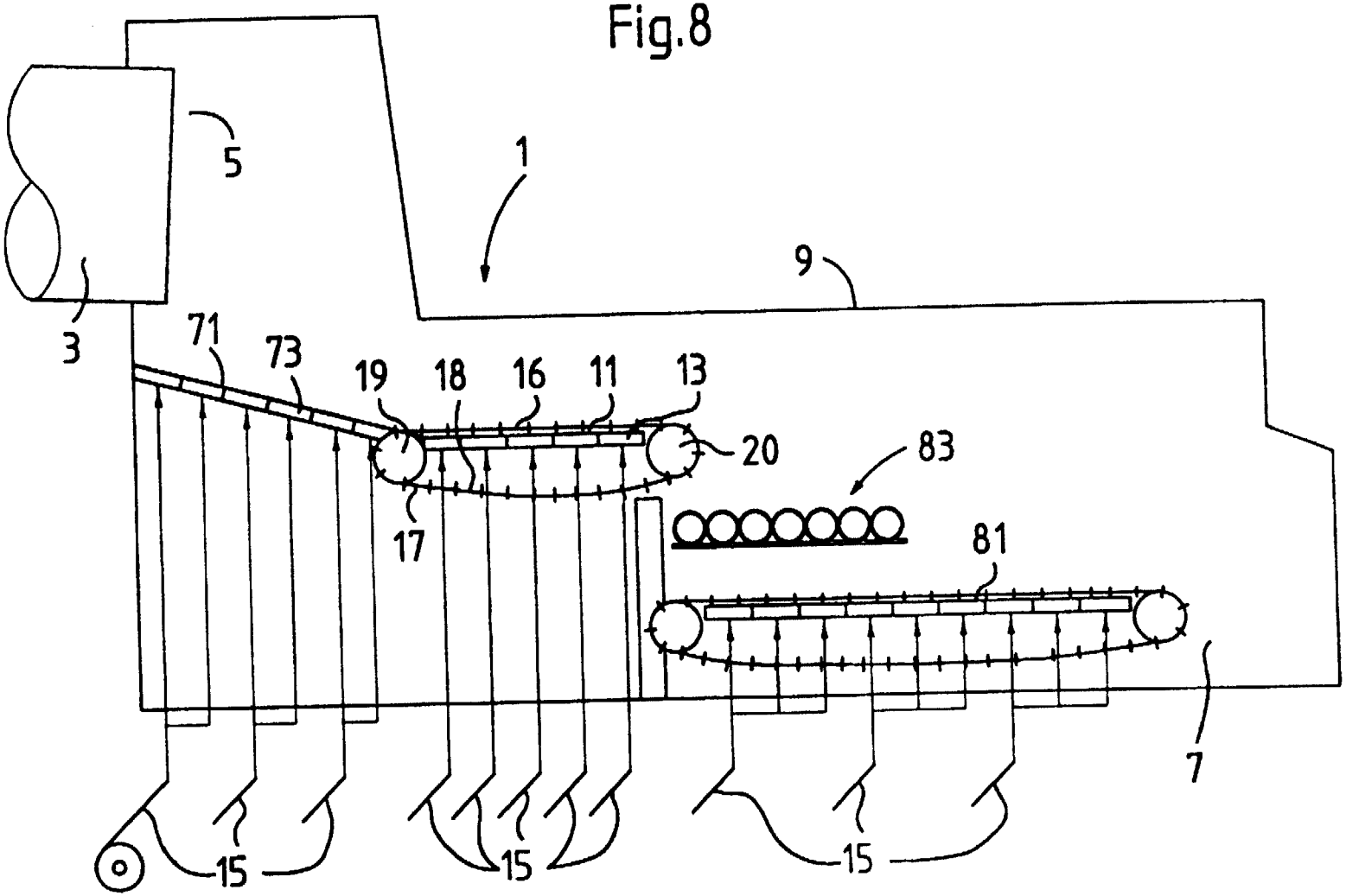
Figure 9:
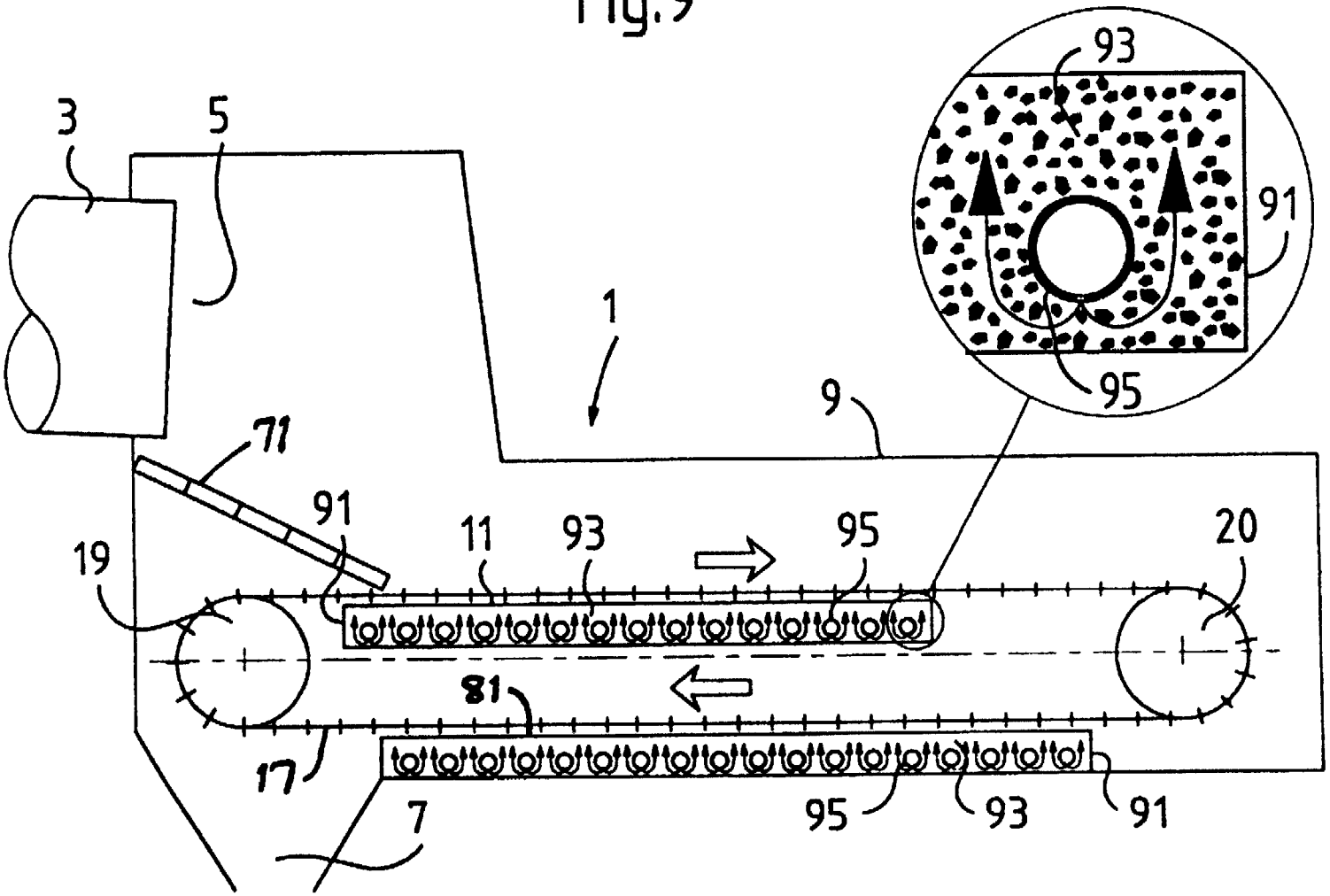

FIG. 8 shows a seventh embodiment of the cooler comprising an inclined grate surface at its inlet, two series-connected grate surfaces separately provided with a conveying device and, between the grate surfaces, a roller crusher; and, FIG. 9 shows an eighth embodiment of the cooler, constructed according to the invention, and comprising two supporting surfaces, each consisting of a tray filled with material and a common chain conveyor.

In the following description of the figures, the same references have generally been used for identical elements.

Figure 1:
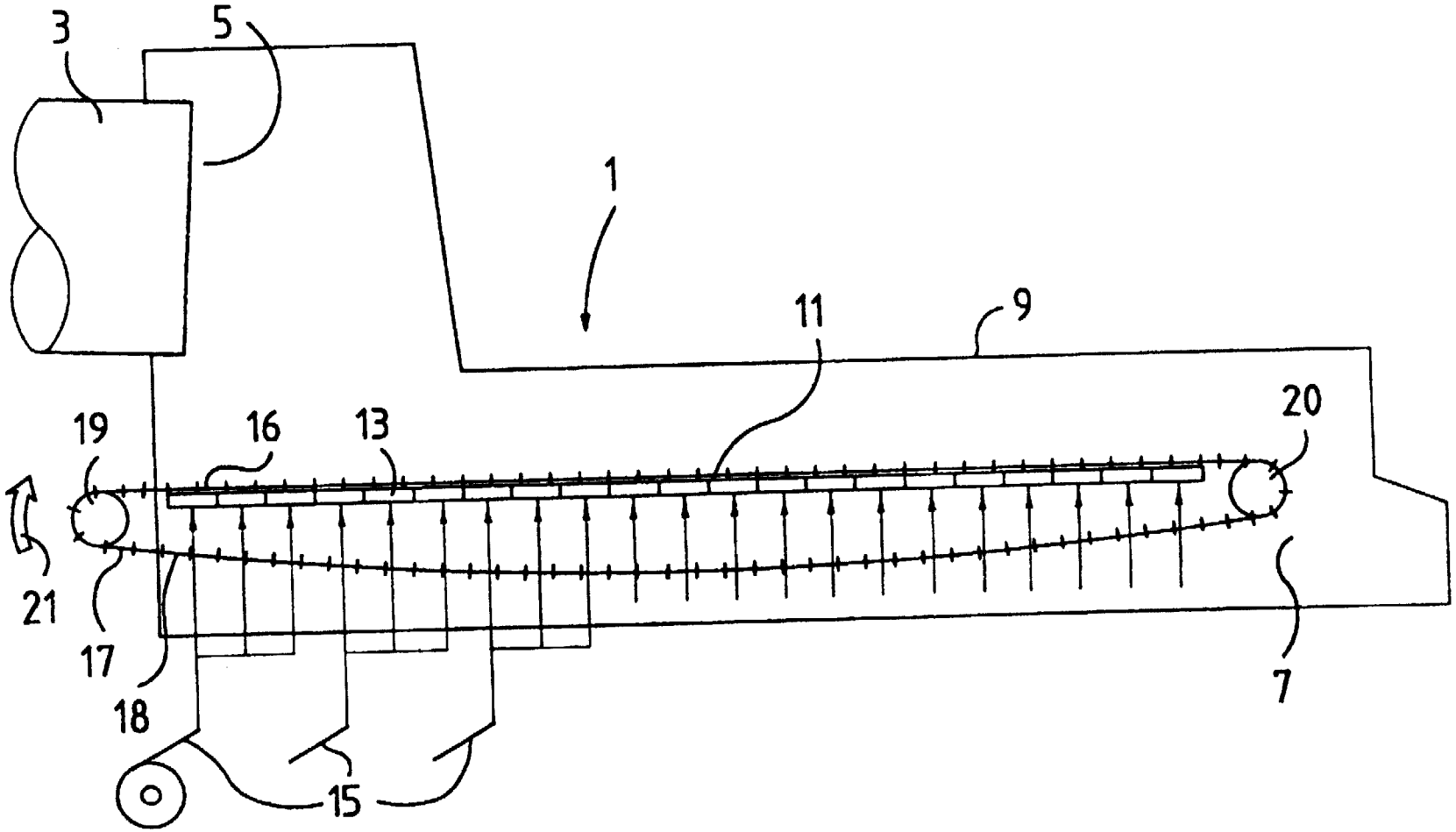
FIG. 1 shows a longitudinal section of a first embodiment of a cooler where the conveying device is a chain conveyor lying true against a supporting surface.

Illustrated in FIG. 1 is a cooler 1 which is mounted in immediate extension of a rotary kiln 3 and designed for cooling material subjected to heat treatment in the kiln 3. The cooler 1 has a material inlet 5 at the kiln 3, a material outlet 7 at the opposite end of the cooler, and a housing 9 which is made up of end walls, side walls, bottom and ceiling. The cooler 1 further comprises a stationary supporting surface 11 which is constructed of rows of grate elements 13, being separately supplied with cooling gas from the underside through the tubes 15. Conveyance of the material through the cooler 1 across the supporting surface 11 is effected by means of a chain conveyor 17 which is running on two chain wheels 19, 20 in the direction indicated by the arrow 21. The upper run 16 of the chain conveyor 17 is carried on the supporting surface 11 and will, during operation, convey the lowermost part of a material bed (not shown) on the supporting surface in the direction towards the material outlet 7. The lower run 18 of the chain conveyor 17 simply remains freely suspended during the movement from the chain wheel 20 to the chain wheel 19.

During operation, a continuous flow of material, such as clinker, is discharged from the rotary kiln 3 and conducted to the cooler inlet S, from which it falls down and forms a material bed on the supporting surface 11. The thickness of this material bed is controlled by means of the chain conveyor 17. Via the tubes 15 and the grate elements 13, cooling gas is blown up through the material bed which is thereby cooled, whereas the cooling gas is correspondingly heated and directed substantially to the rotary kiln for utilization as combustion air, but it can also be used for other purposes.

Figure 2:
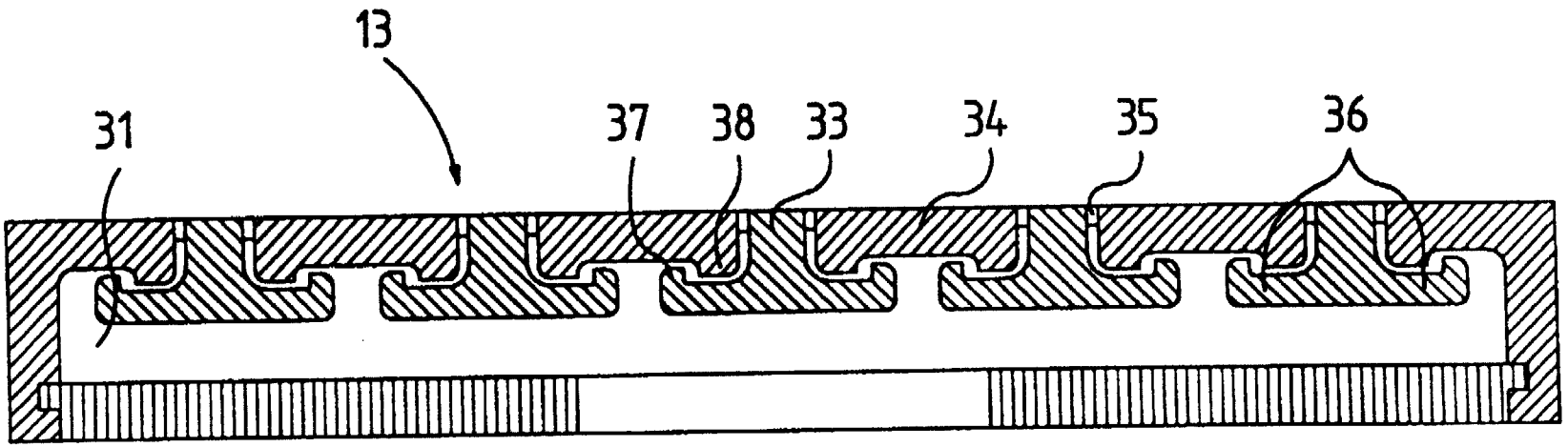
FIG. 2 shows a sectional view of a grate element which may be used for forming a supporting surface.

The grate elements 13 may be constructed like the grate element 13 shown in FIG. 2 and forming the subject of our International Patent Application No. PCT/EP 93/02599. The grate element 13 shown in FIG. 2 is shaped in the form of a box, between the walls 31 of which a number of grate surface-forming grate bars 33, 34 are arranged in relation to one so that they form between them fine gas slots 35. The grate bars alternately consist of bars 34 having a substantially rectangular cross-section and bars 33 having a cross-section substantially of the form of an inverted T, where the rectangular bars 34 overlap the transverse sections 36 of the T-bars 33, each of these sections being provided at the free end with a projecting, longitudinal bead 37, and where each of the rectangular bars 34 at the sides facing the T-bars 33 are correspondingly provided with descending, longitudinal beads 38.

However, as will subsequently be explained with reference to FIG. 9, the supporting surface may also consist of a number of trays.

Figure 3:
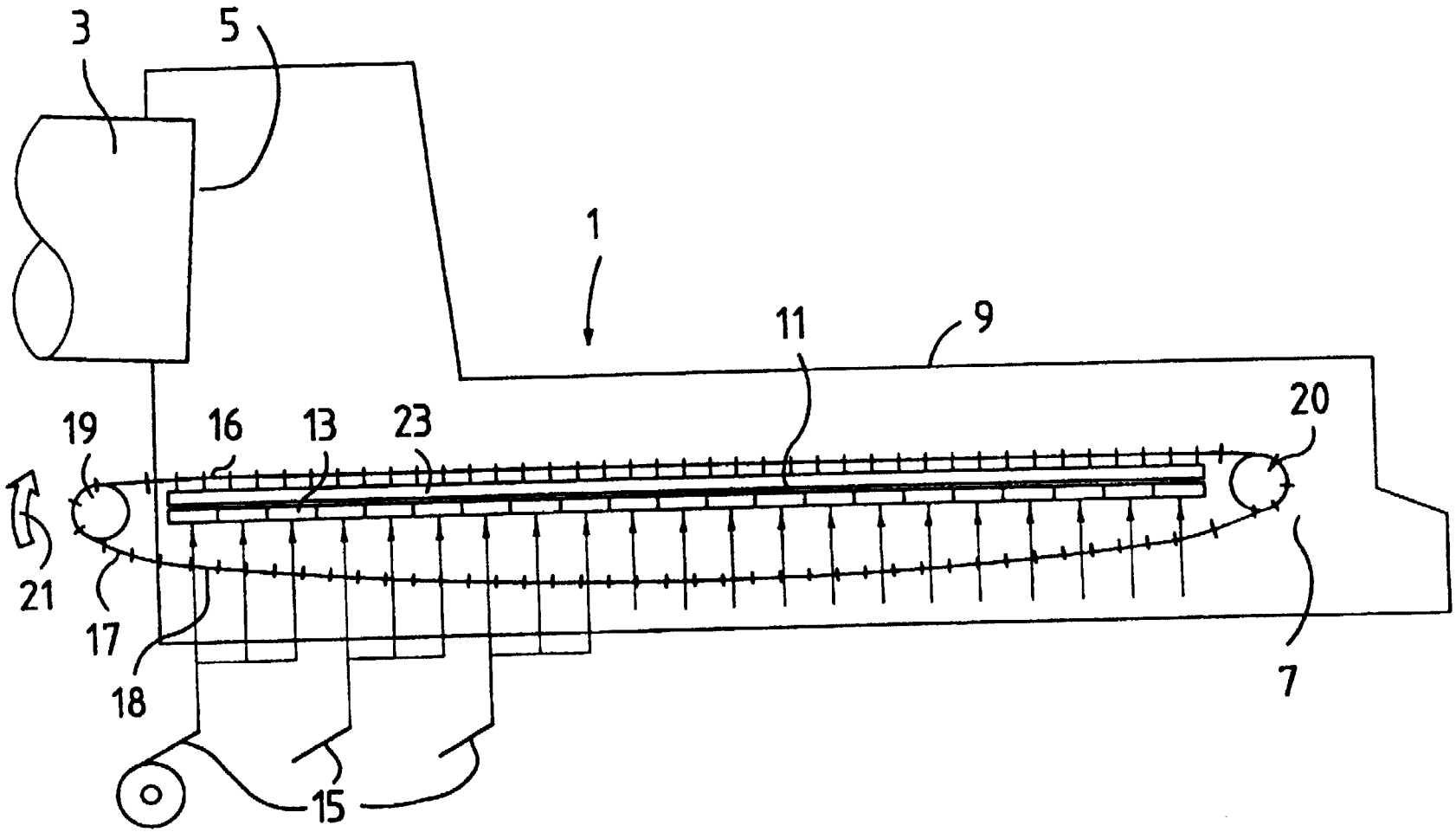
FIG. 3 shows a second embodiment of cooler where the conveying device is a chain conveyor which is elevated in relation to the supporting surface.

The cooler 1 shown in FIG. 3 corresponds to that illustrated in FIG. 1 except that in this embodiment the upper part 16 of the chain conveyor 17 is elevated relative to the supporting surface 11, in that, when moving across the surface, it is carried on separate rails 23 which are placed at a distance above the supporting surface 11. This involves that a small, substantially stationary material bed will be left under the chain conveyor 17 during operation, hence protecting the supporting surface 11 against wear from the moving material bed.

Figure 4:
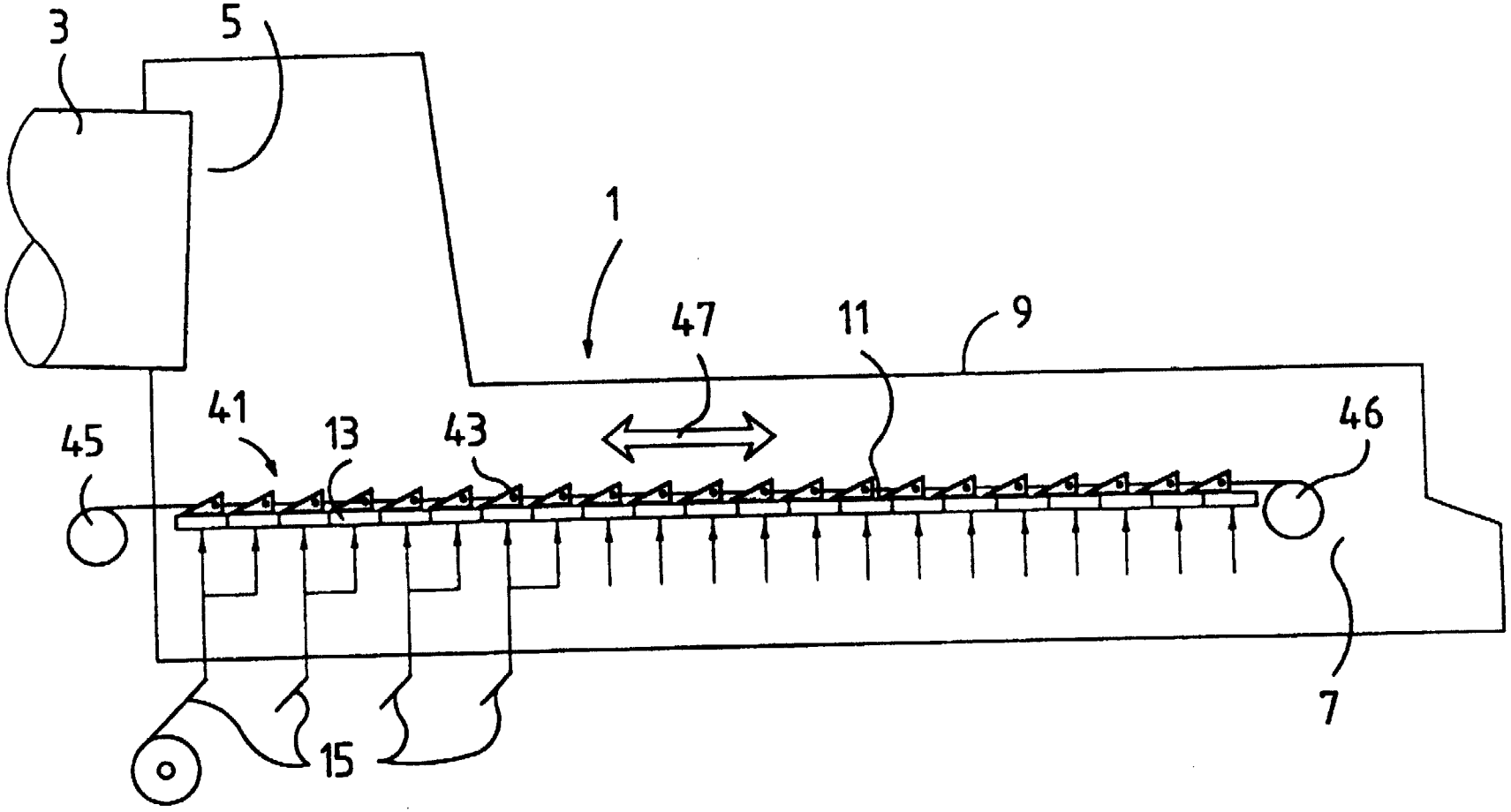
FIG. 4 shows a third embodiment of the cooler where the conveying device consists of a scraping system.

The cooler 1 shown in FIG. 4 corresponds to that illustrated in FIG. 1 except that the conveying device in this embodiment comprises a scraping system 41 which comprises a number of scraping elements 43 which extend transversely to the direction of movement of the material, and having in the shown example a triangular cross-section and moving to and fro in the direction of movement of the material, as indicated by the arrow 47 by means of a not defined driving means 45, 46.

Figure 5:
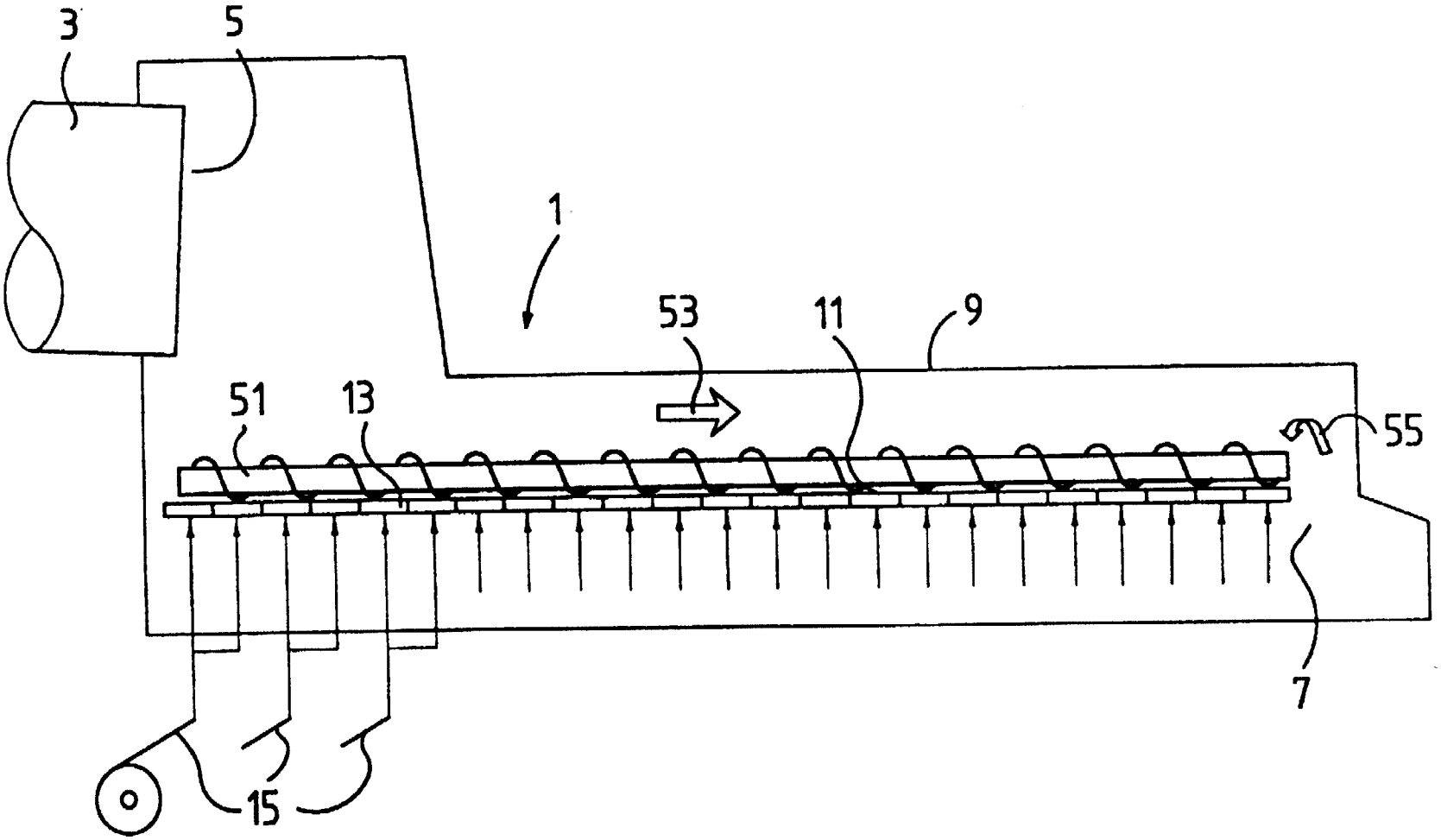
FIG. 5 shows a fourth embodiment of the cooler where the conveying device consists of a number of screw conveyors.

The cooler 1 shown in FIG. 5 corresponds to that illustrated in FIG. 1 except that the conveying device in this embodiment consists of a number of screw conveyors 51 extending in the direction of movement of the material, as indicated by the arrow 51, and rotating around separate axes as indicated by the arrow 55.

Figure 6:
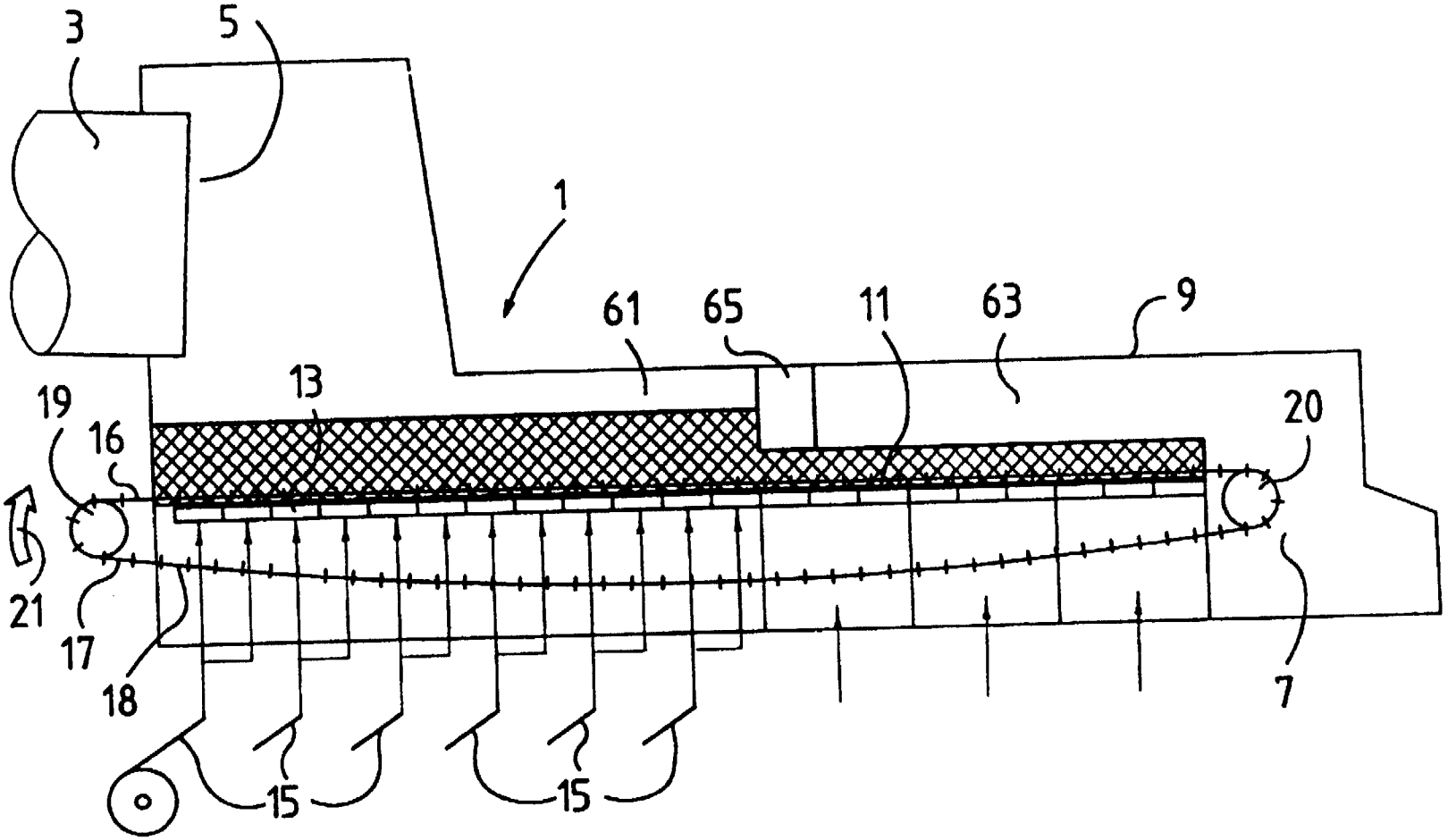
FIG. 6 shows a fifth embodiment of the cooler where the cooler is divided into two parts by means of a wall which is suspended from the ceiling of the cooler.

The cooler 1 shown in FIG. 6 corresponds to that illustrated in FIG. 1 except that it is divided into a first section 61 and a second section 63 by a wall 65 which is suspended from the ceiling transversely to the direction of movement of the material. With this wall it is obtained that the material bed in the first section 61 of the cooler 1 is dammed up, and has the greatest thickness, thereby increasing the counterflow-cooling effect in this part of the cooler.

Figure 7:
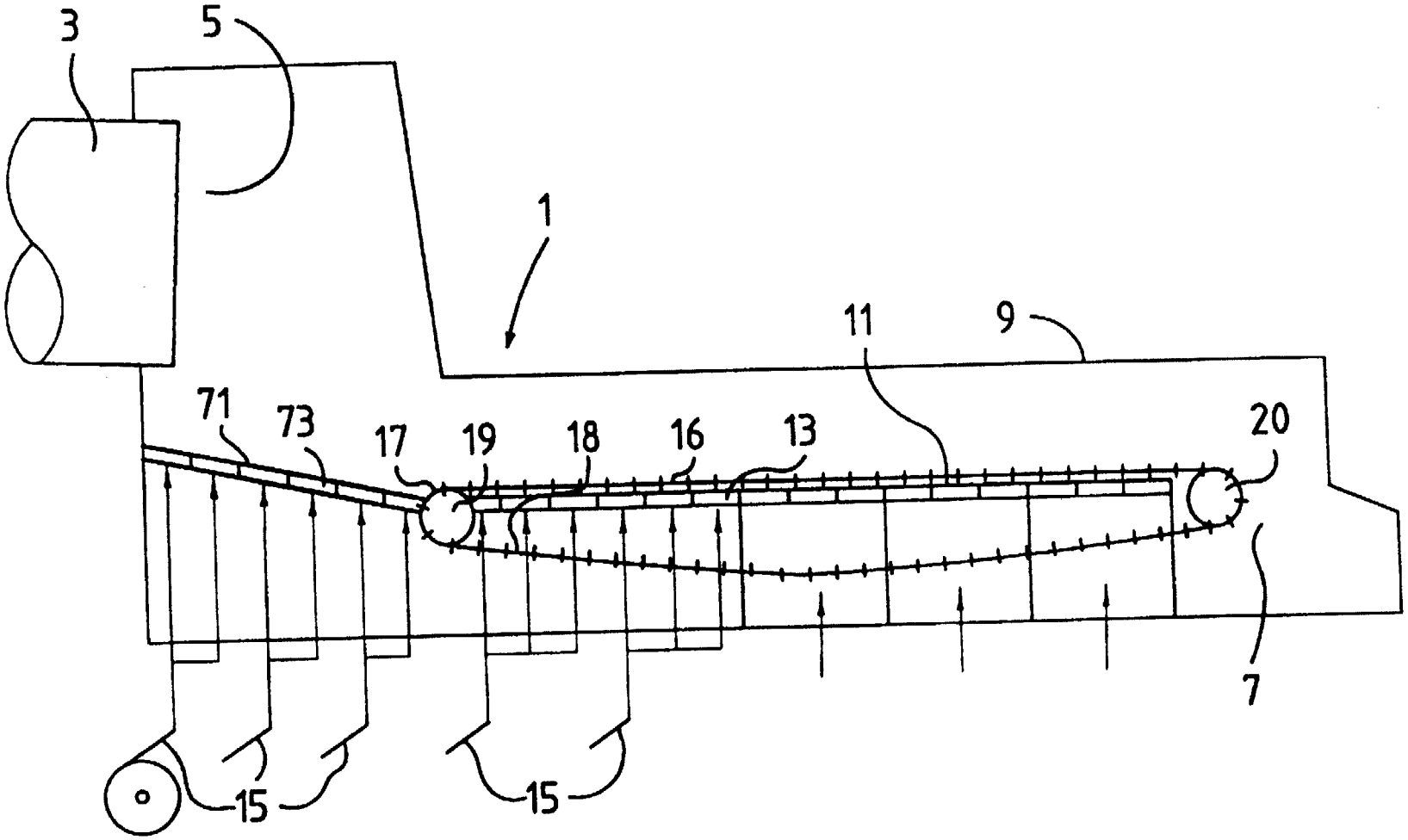
FIG. 7 shows a sixth embodiment of the cooler comprising an inclined grate surface at its inlet.

The cooler 1 shown in FIG. 7 corresponds to that illustrated in FIG. 1 except that it further comprises an inclined grate surface 71 which is located immediately at the cooler inlet 5 and not having any appertaining conveying device. This grate surface 71 is constructed of a number of grate plates 73 being substantially of the same type as the grate elements 13, and each of which is provided with through-going slots or holes for injection of cooling gas through the material from an underlying chamber in order to obtain a certain pre-cooling of the material before it reaches the supporting surface 11 of the cooler.

The cooler 1 shown in FIG. 8 is a modification of the cooler illustrated in FIG. 7, and, as compared to the latter, it further comprises an additional supporting surface 81 in series with the first supporting surface 11, otherwise being of the same design as the cooler shown in FIG. 7. Further, a material crusher, e.g. in the form of a roller crusher 83, is installed between the two supporting surfaces 11 and 81, so that the material can be comminuted to a certain extent, thereby obtaining improved cooling of the material on the additional supporting surface 81.

In principle, the cooler 1 shown in FIG. 9 corresponds to the cooler illustrated in FIG. 1 except that each of the stationary supporting surfaces 11 consists of a tray 91 having the form of a rectangular box with, a substantially imperforate bottom wall, and side and end walls, and which contains, during operation, a quantity of the particulate material 93 which is to be cooled. Further, a number of tubes 95 with, preferably downwardly facing, holes for injection of cooling gas into the material 93 are fitted at the bottom of each tray. As it appears from the shown embodiment, the cooler has two trays 91, of which one is placed under the other in such a way that the material 93 which is scraped off the upper tray by means of the conveying device falls down on the underlying tray for additional cooling thereon. As shown, it is thus possible to convey the material forward across both trays 91 by means of one and the same conveying device.

When not incompatible with the invention, the FIG. 9 embodiment may be modified by the inclusion or substitution of elements of the other embodiments, such as the grate bars 33,34 for one of the supporting surfaces 11,81; or the conveyors 41 or 51; or the wall 65.

Means, such as the conveying device itself, or separate transport means, may be provided for transporting cooled material back to the inlet and on to the surface 11. Thus a lower run of the chain conveyor might be arranged to drag and lift some of the material from the lower surface 81 back up to the upper surface 11. For the chain to do this it might comprise buckets or lifters, or it might run inside a semi-circular channel provided around the chain wheel 19. Another way could simply be to provide an elevator at the end of the supporting surface 81, lifting some of the cooled material to a hopper, e.g. provided in the room under the inclined grate 71, in FIG. 9, from which hopper a layer of cooled material with a predetermined thickness is conveyed into the cooler for covering and protecting the chain against hot clinker material.

I claim:

1. A cooler for cooling particulate material which has been heat-treated in an industrial kiln, such as a rotary kiln for manufacturing cement clinker; the cooler comprising an inlet, and outlet, end walls, side walls, a bottom and a ceiling; at least one stationary supporting surface for receiving and supporting the material which is to be cooled; means for injecting cooling gas into the material at a plurality of positions along the supporting surface; and at least one separate mechanical conveying device positioned over the stationary supporting surface for conveying the material along the supporting surface, characterized in that the at least one of the stationary supporting surface(s) consists of a tray having the form of a rectangular box with bottom, side walls and end walls, the tray being arranged to contain, during operation, a quantity of the particulate material; and in that the gas injection means are fitted within the tray and are arranged such that the quantity of the material contained in the tray is stationary with respect to the cooling means, the bottom of said tray being substantially imperforate to cooling gas.

2. A cooler according to claim 1, wherein the gas injection means are tubes with downwardly facing holes.

3. A cooler according to claim 1 or claim 2, which comprises two trays, one of which is located under the other in such a way that the material which leaves the upper tray falls down onto the underlying tray for further treatment thereon, and in that the material is conveyed forward across both trays by means of one and the same conveying device.

4. A cooler according to claim 1, wherein the conveying device is a chain conveyor which is directly supported on the supporting surface.

* * * * *